US008834107B2

(12) United States Patent
Valliappan et al.

(10) Patent No.: US 8,834,107 B2
(45) Date of Patent: Sep. 16, 2014

(54) TURBINE BLADE TIP SHROUD FOR USE WITH A TIP CLEARANCE CONTROL SYSTEM

(75) Inventors: Lakshmanan Valliappan, Bangalore Karnataka (IN); Moorthi Subramanivan, Karnataka (IN)

(73) Assignee: General Electric Company, Schenectady, NY (US)

( * ) Notice: Subject to any disclaimer, the term of this patent is extended or adjusted under 35 U.S.C. 154(b) by 952 days.

(21) Appl. No.: 12/890,747

(22) Filed: Sep. 27, 2010

(65) Prior Publication Data

US 2012/0076634 A1 Mar. 29, 2012

(51) Int. Cl.
*F01D 11/08* (2006.01)
*F01D 5/22* (2006.01)

(52) U.S. Cl.
CPC ..... *F01D 5/225* (2013.01); *F05D 2250/71* (2013.01); *F05D 2250/18* (2013.01)
USPC ..... 415/173.5

(58) Field of Classification Search
USPC ..... 415/170.1, 173.1, 173.4, 173.5, 173.6, 415/174.4, 174.5
See application file for complete search history.

(56) References Cited

U.S. PATENT DOCUMENTS

| | | | | |
|---|---|---|---|---|
| 6,102,655 | A * | 8/2000 | Kreitmeier | 415/173.3 |
| 6,736,596 | B2 * | 5/2004 | Ito et al. | 415/173.1 |
| 7,338,255 | B2 * | 3/2008 | Nabesaka et al. | 415/173.6 |
| 2012/0121393 | A1 * | 5/2012 | Kuwamura et al. | 415/173.1 |

OTHER PUBLICATIONS

U.S. Appl. No. 12/565,108, filed Sep. 23, 2009, Subramaniyan.

* cited by examiner

*Primary Examiner* — Ned Landrum
*Assistant Examiner* — Woody A Lee, Jr.
(74) *Attorney, Agent, or Firm* — Sutherland Asbill & Brennan LLP

(57) ABSTRACT

The present application provides a tip clearance control system for reducing an airflow through a turbo machine. The tip clearance control system may include a casing shroud and a tip shroud positioned within the casing shroud. The tip shroud may include a first step at a leading edge and a second step adjacent to the first step. The casing shroud and the tip shroud may define a first cavity therebetween downstream of the second step.

11 Claims, 5 Drawing Sheets

TURBINE BLADE TIP SHROUD FOR USE WITH A TIP CLEARANCE CONTROL SYSTEM

TECHNICAL FIELD

The present application relates generally to turbo machinery such as gas turbine engines and more particularly relates to a tip clearance control system with an aerodynamically-shaped turbine blade tip shroud and an accompanying stator casing shroud design to limit leakage therethrough.

BACKGROUND OF THE INVENTION

As is known, turbine blades are rotating airfoil-shaped components designed to convert thermal energy from a working fluid such as gas or steam into mechanical work via the turning of a rotor. There is generally a minimum physical clearance requirement between the tip of the turbine blade and an outer casing for safety and other concerns. This clearance, however, also allows the escape of the some of the working fluid without performing useful work. Performance of a turbine thus may be enhanced by sealing the outer edge of the turbine blade to prevent the working fluid from escaping into the gap. A tip shroud may be used on the blade to seal such a gap. Tip shrouds may enhance turbine performance and also may serve as a vibration damper. A tip seal also may be used on the shroud to minimize leakage into the gap.

The use of a tip shroud, however, may add weight to the overall turbine blade. The heavier the turbine blade, the more centrifugal force created during blade rotation and, hence, the more load and stress placed on the turbine blade and other components. Moreover, the tip shroud also may curl due to a bending load on the edges of the shroud from gas pressure as well as the centrifugal force. Although curl may be limited by providing a thicker tip shroud, the increased thickness generally involves adding even more weight to the tip shroud. Other types of turbo machinery face similar issues.

There is thus a desire for a tip clearance control systems and methods with an improved tip shroud design. Such improved systems and methods for limiting leakage preferably should limit the leakage flows through the tip gap so as to increase overall turbine efficiency but without the additional weight that may impact and limit component lifetime.

SUMMARY OF THE INVENTION

The present application provides a tip clearance control system for reducing an airflow through a turbo machine. The tip clearance control system may include a casing shroud and a tip shroud positioned within the casing shroud. The tip shroud may include a first step at a leading edge and a second step adjacent to the first step. The casing shroud and the tip shroud may define a first cavity therebetween downstream of the second step.

The present application further provides a method of reducing airflow through a gap between a casing shroud and a tip shroud. The method may include the steps of forcing the airflow to take a steep turn about a first step of the tip shroud, elevating the airflow along a second step of the tip shroud towards the casing shroud, and entrapping the airflow within a first cavity defined between the casing shroud and the tip shroud.

The present application further provides a tip clearance control system for a gas turbine. The tip clearance control system may include a casing shroud and a tip shroud positioned within the casing shroud. The casing shroud may include a casing shroud step and a stator rail. The tip shroud may include a first step at a leading edge, a second step downstream of the first step, and a rotor rail downstream of the second step. The stator rail and the rotor rail may define a first cavity therebetween downstream of the second step.

These and other features and improvements of the present application will become apparent to one of ordinary skill in the art upon review of the following detailed description when taken in conjunction with the several drawings and the appended claims.

DETAILED DESCRIPTION OF THE INVENTION

Figure 1:
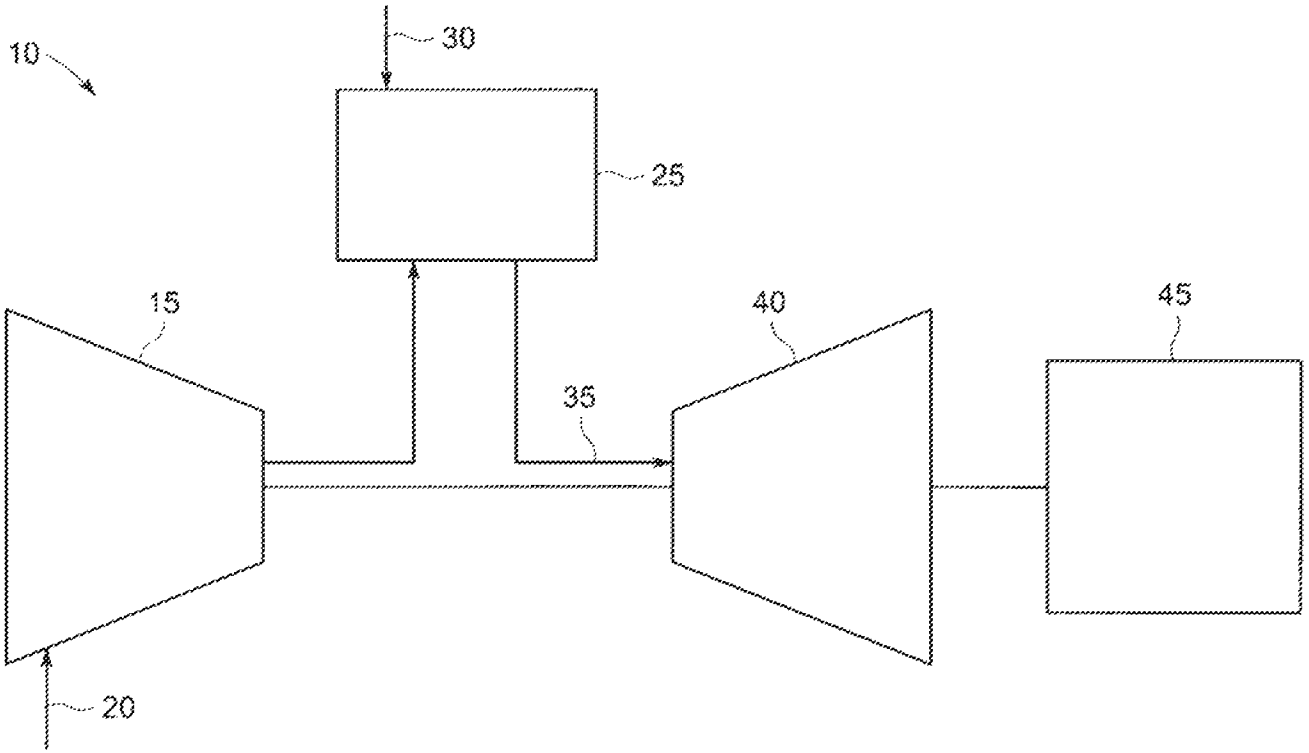
FIG. 1 is a schematic view of a known gas turbine engine.

Referring now to the drawings, in which like numerals refer to like elements throughout the several views, FIG. 1 shows a schematic view of a gas turbine engine 10 as may be described herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air with a compressed flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 and an external load 45 such as an electrical generator and the like.

The gas turbine engine 10 may use natural gas, various types of syngas, and/or other types of fuels. The gas turbine engine 10 may be one of any number of different gas turbine engines offered by General Electric Company of Schenectady, N.Y. The gas turbine engine 10 may have other configurations and may use other types of components. Other types of gas turbine engines also may be used herein. Multiple gas turbine engines 10, other types of turbines, and other types of power generation equipment also may be used herein together. Although the gas turbine engine 10 is shown herein, the present application may be applicable to any type of turbo machinery.

Figure 2:
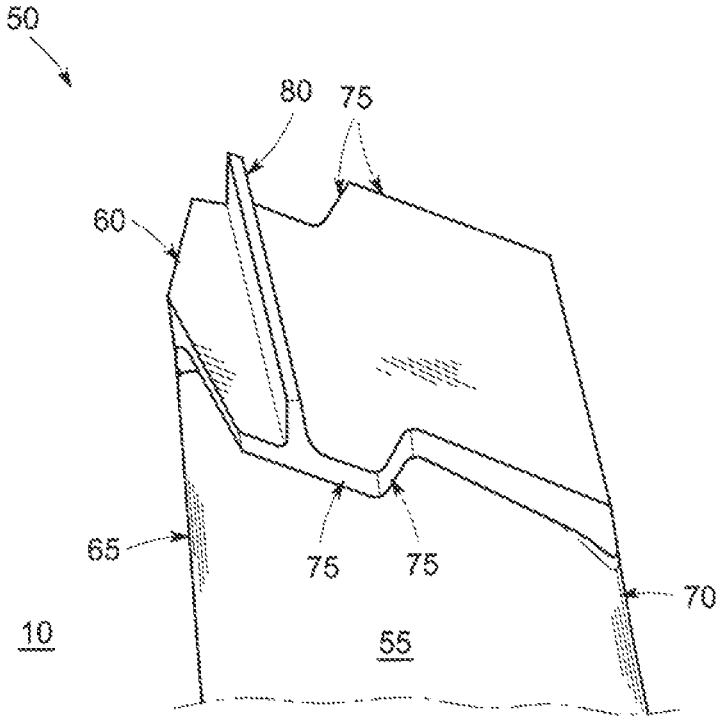
FIG. 2 is a perspective view of a known turbine blade with a tip shroud.

FIG. 2 shows a portion of a convention turbine blade 50 that may be used with the turbine 40 or otherwise. The turbine blade 50 may include an airfoil section 55 and a tip shroud 60. The airfoil 55 may include a leading edge 65 and a trailing edge 70. The edges 65, 70 generally run perpendicular to the tip shroud 60. The tip shroud 60 may have a thickness and a number of sidewalls 75. The sidewalls 75 may be cut to create a locking configuration between adjacent turbine blades 50.

The tip shroud 60 also may have a tip seal 80 thereon. The tip seal 80 may be in the form of a rail or otherwise. One or more tip seals 80 may be used. The tip seals 80 generally run parallel to each other and extend upward from the tip shroud 60. Many different configurations of turbine blades 50 and tip shrouds 60 may be known.

Figure 3:
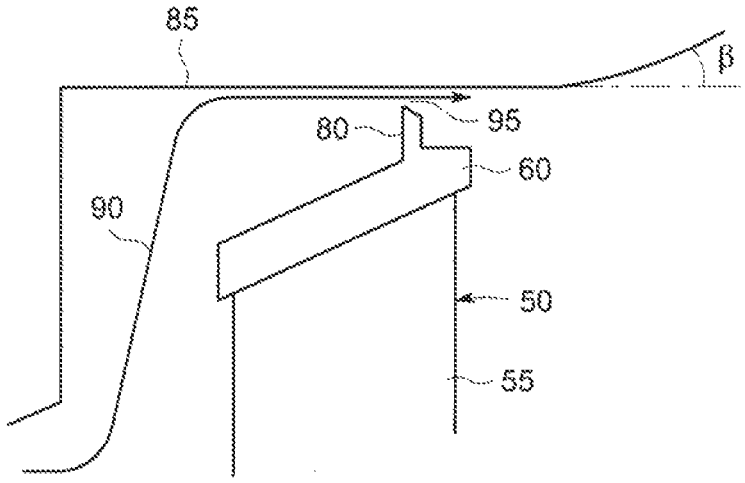
FIG. 3 shows the positioning of the known turbine blade of FIG. 2 within a casing shroud.

FIG. 3 shows a similar turbine blade 50 positioned within a casing shroud 85. A tip leakage flow 90 therebetween is shown therein. The tip leakage flow 90 may be restricted only about a tip gap 95 between the tip seal 80 and the casing shroud 85. Other configurations may be known. Reducing the tip leakage flow 90 through the tip gap 95 thus may improve overall system efficiency by directing more of the working fluid on to the airfoil section 55 so as to produce useful work.

Figure 4:
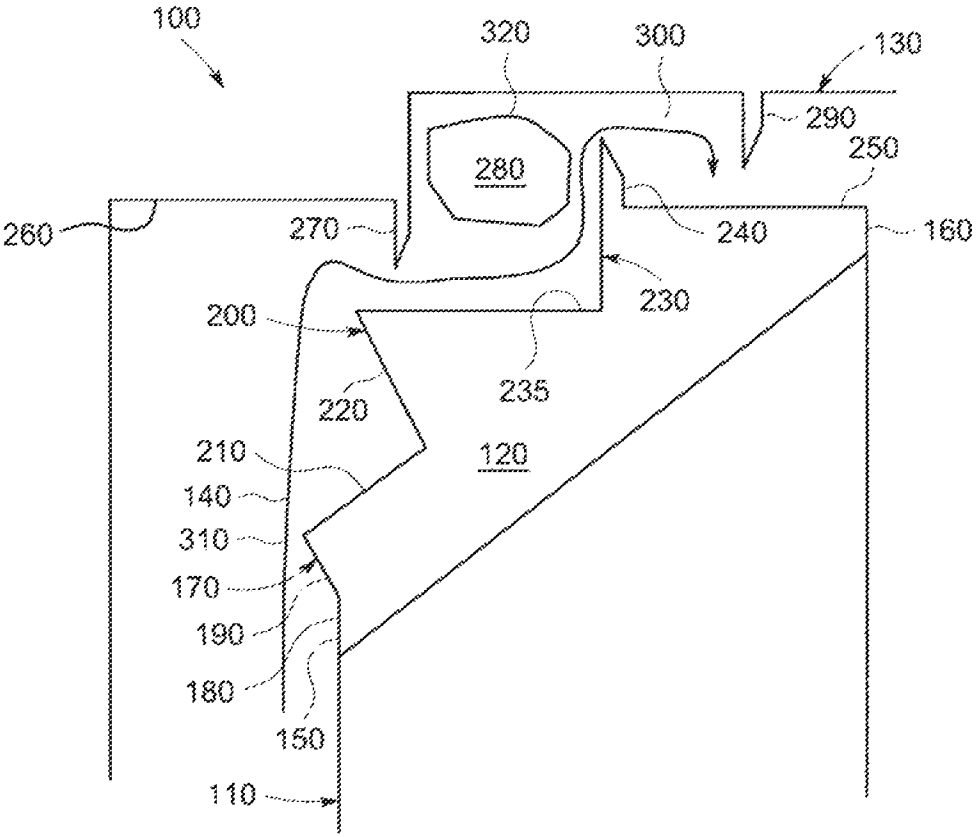
FIG. 4 is a side view of a tip clearance control system as may be described herein.
Figure 5:
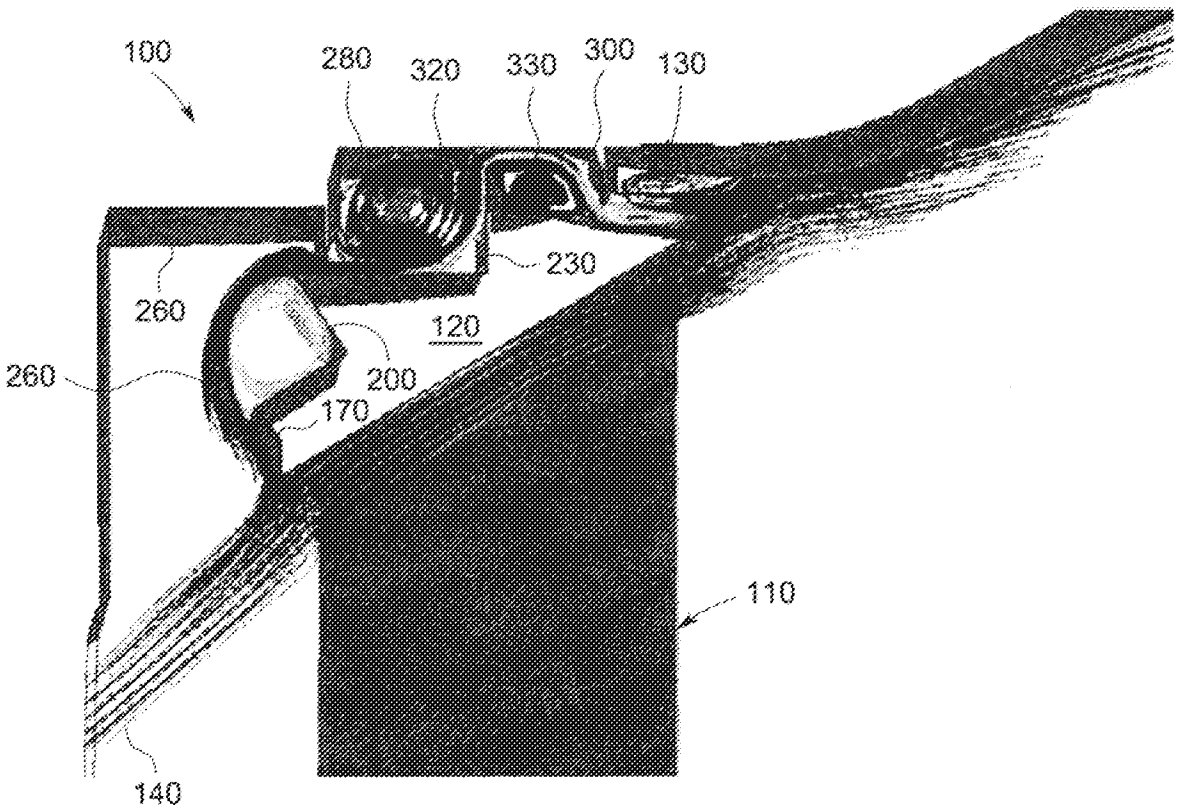
FIG. 5 is a side view of the tip clearance control system of FIG. 4 with airflow patterns shown therein.

FIG. 4 shows a tip gap clearance system 100 as may be described herein. Generally described, the tip gap clearance system 100 may include a turbine blade 110 with a tip shroud 120 thereon. The tip gap clearance system 100 further may include a casing shroud 130. The turbine blade 110 rotates as described above within the casing shroud 130 and defines a path for a flow of air 140 therebetween.

The tip shroud 120 may include a leading edge 150 and a trailing edge 160. The leading edge 150 may take the form of a first step 170. The first step 170 may have a thickness and may have a first step inclined portion 180 leading to a first step straight portion 190. The height and the angle of the first step 170 and the components thereof may vary. Other angles, shapes, and configurations may be used herein. The first step 170 may be shaped to force the flow of air 140 to take an upward turn as it comes into contact therewith.

The tip shroud 120 further may include a second step 200. The second step 200 may be positioned behind the first step 170 in a direction away from the leading edge 150. The second step 200 also may include a second step inclined portion 210 leading to a second step straight portion 220. The second step inclined portion 210, and the second step straight portion 220 may form about a right angle therebetween. The height and the angle of the second step 200 and the components thereof may vary. Other angles, shapes, and configurations may be used herein. The second step 200 may be shaped to force the flow of air 140 towards the casing shroud 130.

The tip shroud 120 also may include a third step 230. The third step 230 may extend horizontally away from the second step 200 in a first flat portion 235. The third step 230 then may extend upwardly from the second step 200 and may define a rotor tooth or rail 240 thereon. Any number of rotor rails 240 may be used herein. The third step 230 further may include a second flat portion 250 extending behind the rotor rail 240 to the trailing edge 160. The length and the angle of the third step 230 and the rotor rail 240 may vary. Other angles, shapes, and configurations may be used herein.

The casing shroud 130 also may include a casing shroud step 260 positioned therein. The casing shroud step 260 may be a downward step positioned above the leading edge 150 of the tip shroud 120 or otherwise and extending into the flow of air 140. The casing shroud step 260 may end about a first stator tooth or rail 270. The length and the angle of the casing shroud step 260 may vary. Other configurations may be used herein. The first stator rail 270 may extend downwardly towards the second step 200 of the tip shroud 120. The height and the configuration of the stator rail 270 may vary. Any number of first stator rails 270 may be used. Other configurations may be used herein.

The casing shroud 130 then may extend upwardly and define a first cavity 280 therein. The first cavity 280 may extend from about the first stator rail 270 of the casing shroud 130 to the rotor rail 240 of the tip shroud 120. The first cavity 280 thus may be defined between the first stator rail 270 and the first rotor rail 240. The height and the length of the first cavity 280 may vary. Other configurations also may be used herein.

A second stator tooth or rail 290 may be positioned downstream of the first cavity 280. Any number of second stator rails 290 may be used herein. The height and the configuration of the stator rail 290 may vary. A second cavity 300 may be formed between the first rotor rail 240 and the second stator rail 290. The height and the length of the second cavity 300 may vary. Any number of cavities 280, 300 may be formed herein. Other configurations may be used herein.

The tip gap clearance system 100 thus limits the airflow 140 that may pass therethrough. Specifically, the first step 170 is forward facing at the leading edge 150 of the tip shroud 120 so as to force the airflow 140 to take a steep upward turn 310. The second step 200 may be elevated above the first step 170 so as to cooperate with the casing shroud step 260. The combination of the second step 200 and the casing shroud step 260 reduces the clearance between the tip shroud 120 and the casing shroud 130. This elevated clearance also creates the first cavity 280 therebetween. The shape of the first cavity 280 may result in the airflow 140 creating a first vortex 320 therein. The first vortex 320 may make the airflow 140 take a bigger path so as to force the airflow 140 to climb the rotor rail 240 about the third step 230. Likewise, the airflow 140 may create a second vortex 330 downstream within the rotor rail 240 and the second stator rail 290 of the second cavity 300. Other types of airflows may be used herein.

The tip gap clearance system 100 thus forces the airflow 140 to turn and travel to a higher radius so as to limit the flow therein and through the tip gap 95. Tip leakage flow is one of the major loss sources in a turbine. As such, overall leakage flow may be reduced herein while overall stage efficiency may be increased. A reduction in the tip leakage flow thus may lead directly proportionately to turbine performance gains. The use of the cavities 280, 300 also helps reduce the overall weight of the tip shroud 120.

Figure 6:
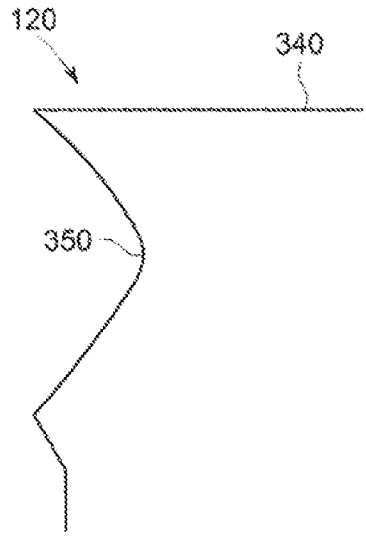
FIG. 6 is a side view of an alternative embodiment of a tip shroud as may be described herein.
Figure 7:
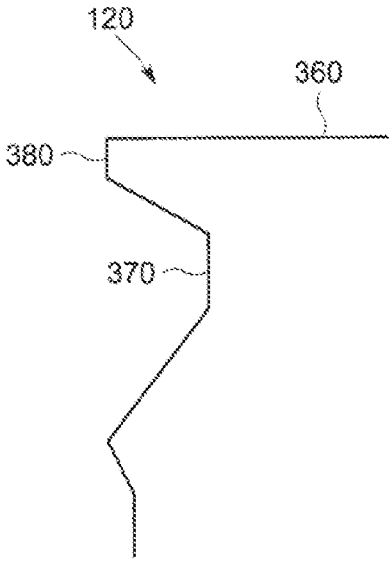
FIG. 7 is a side view of an alternative embodiment of a tip shroud as may be described herein.
Figure 8:
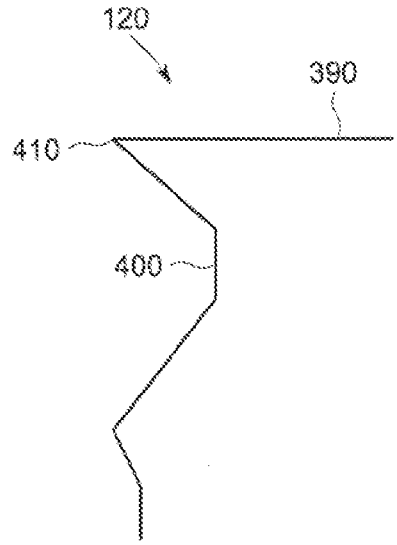
FIG. 8 is a side view of an alternative embodiment of a tip shroud as may be described herein.

FIGS. 6-8 show variations on the tip shroud 120 and the second step 200 in particular. FIG. 6 shows an example of a second step 340. In this example, the second step 340 may have a curved shape 350. FIG. 7 shows a further example of a second step 360. In this example, the second step 360 may have an indented shape 370 with a blunt upper edge 380. FIG. 8 shows a further example of a second step 390. In this example, the second step 390 also includes an indented shape 400, but the indented shape 400 leads to a sharp upper edge 410. Many other shapes and configurations may be used herein.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A tip clearance control system for reducing an airflow through a turbo machine, the tip clearance control system comprising:

a casing shroud, comprising:

a casing shroud step;

a first stator rail positioned downstream of the casing shroud step; and a second stator rail positioned downstream of the first stator rail; and a tip shroud positioned within the casing shroud, the tip shroud comprising:

a first step at a leading edge, wherein the first step comprises (i) a first portion extending vertically from the leading edge and (ii) a second portion extending from the first portion upward and in an upstream direction relative to the airflow to form an angle about the leading edge;

a second step positioned downstream of the first step, wherein the second step comprises (i) a first portion extending from the first step upward and in a downstream direction relative to the airflow and (ii) a second portion extending from the first portion of the second step upward and in an upstream direction relative to the airflow;

a third step positioned downstream of the second step, wherein the third step comprises (i) a first portion extending horizontally from the second step and (ii) a second portion extending vertically from the first portion of the third step; and a rotor rail extending towards the casing shroud between the first stator rail and the second stator rail, wherein the first stator rail and the rotor rail define a first cavity, and wherein the rotor rail and the second stator rail define a second cavity downstream of the first cavity.

2. The tip clearance control system of claim 1, wherein the first portion of the second step and the second portion of the second step form about a right angle therebetween.

3. The tip clearance control system of claim 1, wherein the second step comprises a curved shape.

4. The tip clearance control system of claim 1, wherein the second step comprises a first surface, a second surface, and a third surface forming an indented shape.

5. The tip clearance control system of claim 1, wherein the third step comprises a third portion extending horizontally between the rotor rail and a trailing edge.

6. The tip clearance control system of claim 1, wherein the casing shroud step is positioned about the second step.

7. The tip clearance control system of claim 6, wherein the first stator rail is positioned about the casing shroud step.

8. The tip clearance control system of claim 1, further comprising the airflow extending through a gap between the casing shroud and the tip shroud.

9. The tip clearance control system of claim 1, wherein the airflow comprises a first vortex within the first cavity.

10. A system for reducing an airflow through a turbo machine, the system comprising:

a compressor;

a combustor in communication with the compressor; and a turbine in communication with the combustor, wherein the turbine comprises:

a casing shroud, comprising:

a casing shroud step;

a first stator rail positioned downstream of the casing shroud step; and a second stator rail positioned downstream of the first stator rail; and a tip shroud positioned within the casing shroud, the tip shroud comprising:

a first step at a leading edge, wherein the first step comprises (i) a first portion extending vertically from the leading edge and (ii) a second portion extending from the first portion upward and in an upstream direction relative to the airflow to form an angle about the leading edge;

a second step positioned downstream of the first step, wherein the second step comprises (i) a first portion extending from the first step upward and in a downstream direction relative to the airflow and (ii) a second portion extending from the first portion of the second step upward and in an upstream direction relative to the airflow;

a third step positioned downstream of the second step, wherein the third step comprises (i) a first portion extending horizontally from the second step and (ii) a second portion extending vertically from the first portion of the third step; and a rotor rail extending towards the casing shroud between the first stator rail and the second stator rail, wherein the first stator rail and the rotor rail define a first cavity, and wherein the rotor rail and the second stator rail define a second cavity downstream of the first cavity.

11. The tip clearance control system of claim 1, wherein the airflow comprises a second vortex within the second cavity.

* * * * *